US012235087B1

(12) United States Patent
White

(10) Patent No.: US 12,235,087 B1
(45) Date of Patent: Feb. 25, 2025

(54) FIREARM CARTRIDGE AND METHOD WITH COPPER FOULING ABATEMENT

(71) Applicant: FN HERSTAL, S.A., Herstal (BE)

(72) Inventor: Patrick J. White, Columbia, SC (US)

(73) Assignee: FN Herstal, S.A., Herstal (BE)

( * ) Notice: Subject to any disclaimer, the term of this patent is extended or adjusted under 35 U.S.C. 154(b) by 0 days.

(21) Appl. No.: 18/811,128

(22) Filed: Aug. 21, 2024

(51) Int. Cl.

| | |
|---|---|
| ***F42B 12/74*** | (2006.01) |
| ***C22C 19/03*** | (2006.01) |
| ***C23C 18/16*** | (2006.01) |
| ***C23C 18/50*** | (2006.01) |
| ***F42B 5/24*** | (2006.01) |
| ***F42B 12/80*** | (2006.01) |
| ***F42B 33/00*** | (2006.01) |

(52) U.S. Cl.
CPC ..... *F42B 12/80* (2013.01); *C22C 19/03* (2013.01); *C23C 18/1637* (2013.01); *C23C 18/50* (2013.01); *F42B 5/24* (2013.01); *F42B 12/74* (2013.01); *F42B 33/00* (2013.01)

(58) Field of Classification Search
CPC .. F42B 5/24; F42B 12/74; F42B 12/80; F42B 12/82; F42B 33/00; F42B 33/001; F42B 33/14; C22C 19/03; B21K 21/06; C23C 18/50; C23C 18/1637
USPC ..... 102/501–517
See application file for complete search history.

(56) References Cited

U.S. PATENT DOCUMENTS

| | | | | |
|---|---|---|---|---|
| 2,532,283 | A | 12/1950 | Brenner et al. | |
| 3,049,998 | A | 8/1962 | Brown | |
| 4,196,670 | A * | 4/1980 | Vatsvog | F42B 12/80 427/419.7 |
| 4,328,750 | A | 5/1982 | Oberg et al. | |
| 4,714,023 | A * | 12/1987 | Brown | B32B 15/01 102/501 |
| 5,597,975 | A | 1/1997 | Satow | |
| 6,935,243 | B2 * | 8/2005 | Dippold | F42B 12/34 102/508 |
| 6,973,879 | B1 | 12/2005 | McElroy et al. | |
| 9,254,503 | B2 * | 2/2016 | Ward | F42B 12/80 |
| 11,353,302 | B1 * | 6/2022 | Steffner | F42B 14/04 |
| 11,512,935 | B2 | 11/2022 | Carbone et al. | |
| 11,852,449 | B2 * | 12/2023 | Nichols | F42B 12/74 |
| 11,867,489 | B2 * | 1/2024 | Beswick | F42B 5/24 |
| 2023/0168071 | A1 | 6/2023 | Suman | |

OTHER PUBLICATIONS

Longdistanceoperator—Shoot Utah Airguns, "Cleaning barrel after using nickle plated bullets", pp. 1-14, Sep. 24, 2020.

* cited by examiner

*Primary Examiner* — James S Bergin
(74) *Attorney, Agent, or Firm* — Williams Mullen; Thomas F. Bergert

(57) ABSTRACT

Embodiments of the present disclosure provide a firearm cartridge with an electroless nickel bullet coating. In embodiments, a nickel-phosphorous alloy is deposited on a copper bullet to produce a coated bullet, a propellant with a copper inhibiting additive is inserted in a cartridge casing and the coated bullet is inserted in the mouth of the casing. Embodiments of the firearm cartridge include a casing, a propellant with a copper inhibiting additive positioned in the cavity of the casing and a copper bullet secured within the casing, wherein the copper bullet has a nickel-phosphorous coating.

11 Claims, 2 Drawing Sheets

FIREARM CARTRIDGE AND METHOD WITH COPPER FOULING ABATEMENT

TECHNICAL FIELD

The present disclosure relates to firearms and, more particularly, to a firearm cartridge and method for production.

BACKGROUND AND SUMMARY

Firearm cartridges are units of ammunition that generally include a casing, gunpowder, a primer and a bullet. Gunpowder is retained in the body of the casing, with the primer at one end of the casing and the bullet at the other end of the casing. When the firearm is fired, a striker in the form of a firing pin or hammer contacts the primer which detonates the gunpowder, generating pressure on the base of the bullet to force the bullet through the firearm barrel towards a target. Rimfire cartridges have the primer along the circumference of the base of the cartridge, whereas centerfire cartridges have the primer in a hole in the center of the cartridge base.

Bullets can be formed monolithically or provided as an inner core covered by a jacket. Historically, bullets have been made by adding a copper jacket to a lead core. Solid copper bullets have become more common recently in part to reduce the opportunity for lead contamination. Copper bullets, or copper jacketed bullets leave copper fouling in a barrel, which decrease accuracy, and can cause unsafe increases in cartridge pressures especially when present near the start of rifling (referred to as the leade), which can lead to malfunctions and personal hazards. While solid copper bullets are non-toxic, solid copper bullets produce more copper fouling in a barrel than traditional lead-core bullets, which is a significant factor limiting the widespread use of monolithic bullets. Modern copper inhibiting powders include additives to help control coppering, but do not prevent the buildup of copper near the leade, and therefore do not resolve safety and reliability issues.

In various embodiments, the electroless nickel bullet coating and copper-inhibiting propellant according to the present disclosure enables high-volume fire without concern about copper build-up. The coating also applies a transfer film to the barrel that subsequently makes it easier to remove fouling from the barrel. The transferred nickel also protects the underlying barrel material and leads to prolonged barrel life.

Various embodiments of the present disclosure employ electroless nickel bullet coatings. These coatings may be used, for example, on monolithic copper bullets or bullets made predominantly from copper that may or may not include metal penetrators. Embodiments may also be used with pistol caliber bullets. By employing an electroless nickel plating process according to the present disclosure, coppering can be prevented and the life of the firearm barrel can be extended. Prevention of coppering is highly desirable, particularly with regard to military and law enforcement applications for monolithic bullets. The present disclosure is a key technology that enables the wide-spread use of lead-free ammunition.

In various embodiments, the electroless nickel is deposited according to American Society for Testing and Materials (ASTM) standard B733, Type IV, Class I, which corresponds to electroless deposited nickel, with medium phosphorous content, in the non-heat-treated condition.

In various embodiments, a copper inhibiting powder is employed in the cartridge casing to further hinder the transfer of copper to the firearm barrel, thereby avoiding the undesirable effects of coppering altogether. Embodiments of the present disclosure can employ a solid copper bullet or a bullet with a copper jacket or shell.

DETAILED DESCRIPTION OF EMBODIMENTS

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

It will be appreciated that reference to "a", "an" or other indefinite article in the present disclosure encompasses one or a plurality of the described element. Thus, for example, reference to a bullet may encompass one or more bullets, reference to a powder may encompass one or more powders, and so forth.

Figure 1:
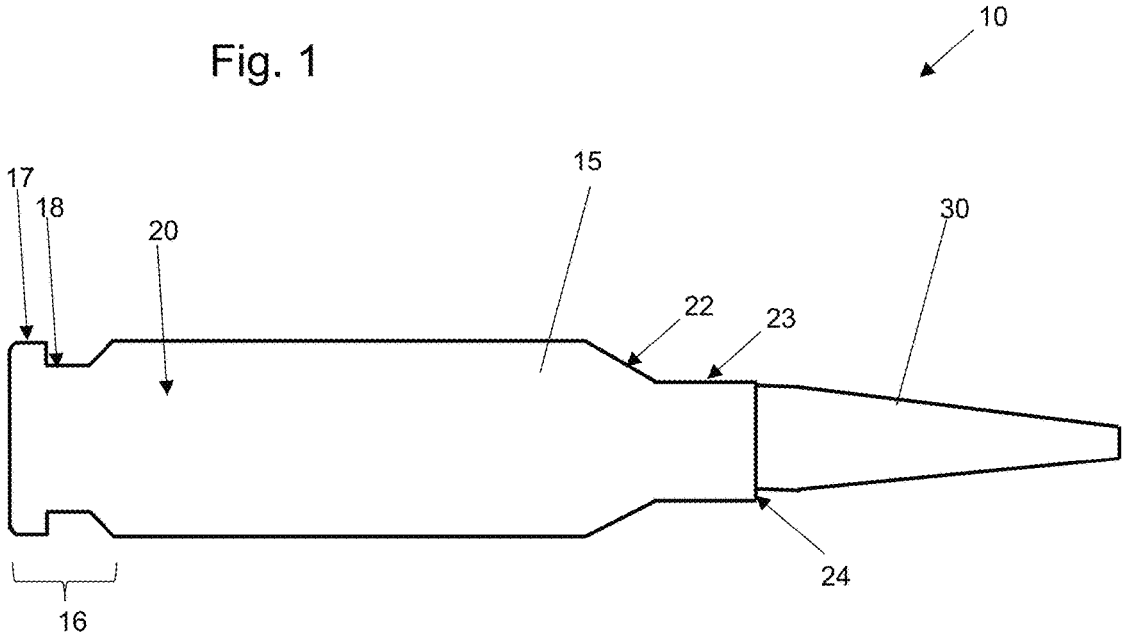
FIG. 1 shows a schematic diagram of a firearm cartridge according to embodiments of the present disclosure.
Figure 2:
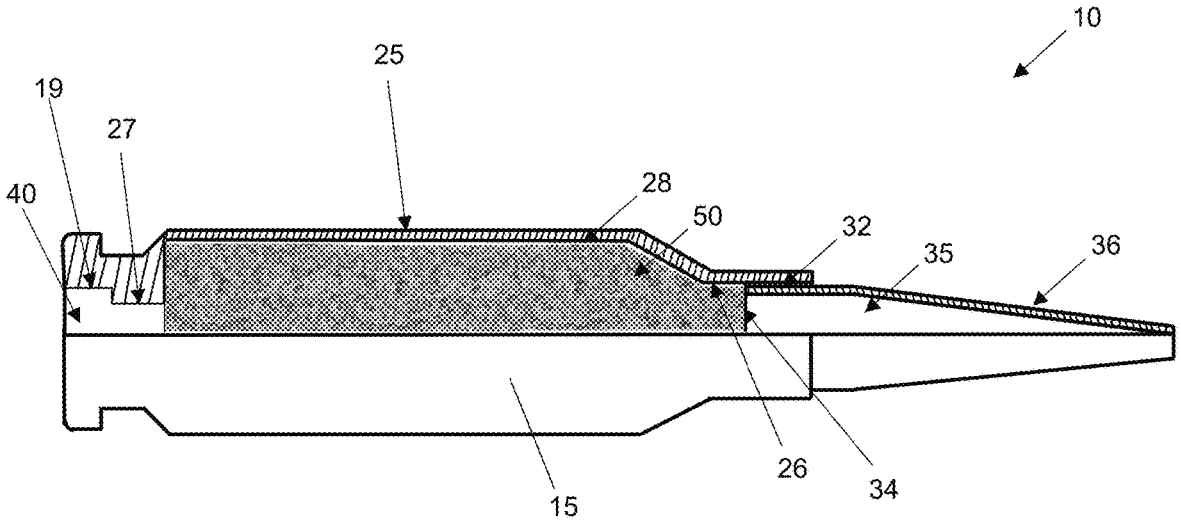
FIG. 2 shows a partial cross-sectional view of a head, casing and bullet of the firearm cartridge of FIG. 1 in accordance with embodiments of the present disclosure.

FIGS. 1 and 2 are diagrams of a firearm cartridge 10 according to embodiments of the present disclosure. As shown therein, the cartridge 10 includes a casing 15, a bullet 30, a rearward primer 40 and a propellant 50. The primer 40 is not shown in cross-section but appears in the head 16 of the casing 15. According to various embodiments, the head 16 is integrally and/or monolithically formed with the casing 15 and includes a rim 17, an extractor groove 18 and a primer pocket 19 which receives the primer 40. The primer 40 is shown as a centerfire primer in FIG. 2; however, it will be appreciated that embodiments of the present disclosure can operate with a rimfire primer. The casing 15 includes a body 20 having a wall 25 defining a cavity 28 which can store the propellant 50. The casing 15 further includes a shoulder 22 and neck 23, wherein the axial edge 24 of the neck 23 forms a mouth into which a bullet 30 can be inserted and secured/retained during manufacture.

The bullet 30 is provided with a bearing surface 32 and a base 34, wherein the bearing surface 32 is in friction fit with the interior surface 26 of the casing 15 when installed. When a firearm employing the ammunition cartridge 10 is fired, a striker in the form of a firing pin or hammer contacts the primer 40 which extends through a flash hole 27 of the casing head 16 and detonates the propellant 50, generating pressure on the base 34 of the bullet 30 to force the bullet 30 out of the casing 15 and through the firearm barrel.

In various embodiments, the bullet 30 is a copper bullet having a nickel-phosphorous coating. It will be appreciated that reference to a copper bullet herein can relate to a monolithic, pure and/or elemental copper bullet, a copper alloy bullet as well as a bullet having a copper shell or jacket. Bullet 30 in FIGS. 1 and 2 is an exemplary copper bullet with a core 35 and a copper jacket 36. The core 35 may be a material other than copper according to various embodiments. The nickel-phosphorous coating can be produced via electroless nickel plating. In various embodiments, the nickel-phosphorous coating is produced by bathing the copper bullet in a nickel-phosphorous alloy and measures up to and including 0.0005 inch in thickness. In various embodiments, the minimum thickness is 0.0001 inch. In various embodiments, the nickel-phosphorous alloy has a phosphorous content of five to nine percent. It will be appreciated that other measurements for the coating and other phosphorous content may be employed in various embodiments. In various embodiments, bathing the copper bullet in the nickel-phosphorous alloy is performed without current.

In various embodiments, the propellant 50 is provided as gunpowder with a copper inhibiting additive. The gunpowder can be, for example, SMP-842™ with additive produced by St. Marks Powder of Crawfordville, Florida.

Figure 3:
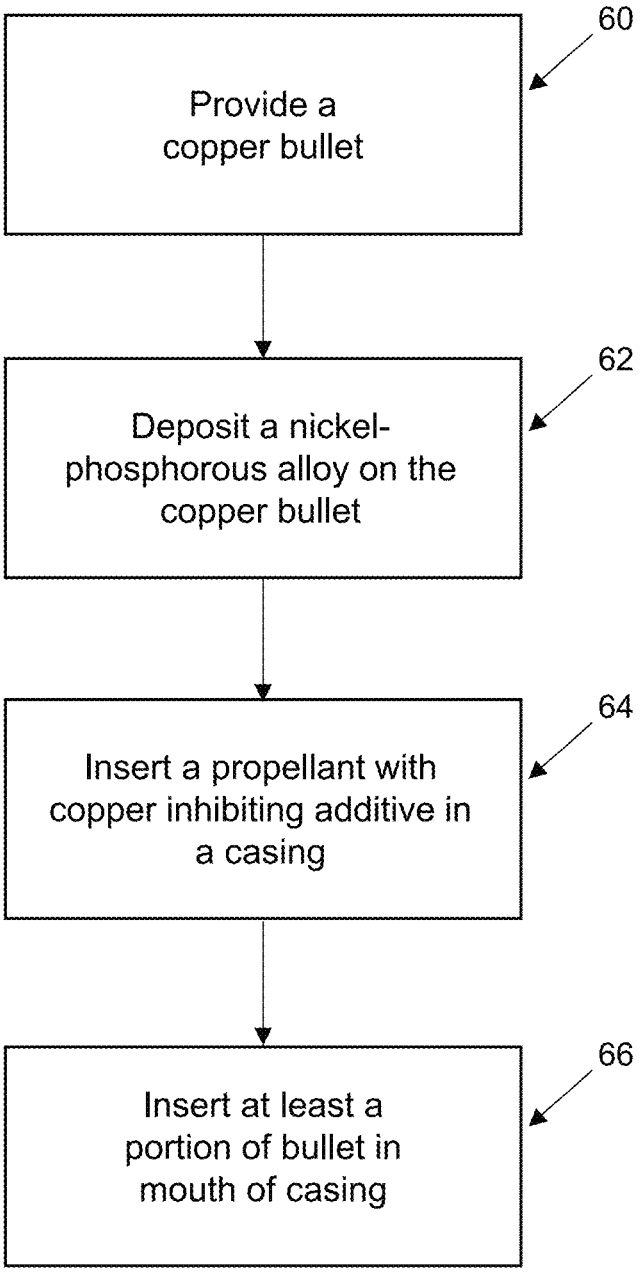
FIG. 3 is a flow diagram of a method in accordance with embodiments of the present disclosure.

FIG. 3 illustrates an exemplary method of producing a firearm cartridge in accordance with embodiments of the present disclosure. As shown at 60, a copper bullet is provided. As at 62, a nickel-phosphorous alloy is deposited on the copper bullet. As at 64, a propellant with a copper inhibiting additive is inserted in a cartridge casing. As at 66, at least a portion of the bullet is inserted in a mouth of the casing. Depositing the nickel-phosphorous alloy on the copper bullet can be performed by placing the copper bullet in a plating bath. Further, according to embodiments, depositing the nickel-phosphorous alloy on the copper bullet is performed without current. As described elsewhere herein, in various embodiments, the bullet can include a nickel-phosphorous coating measuring from 0.0001 inch to 0.0005 inch and the nickel-phosphorous alloy can have a phosphorous content of five to nine percent.

In various embodiments, depositing the nickel-phosphorous alloy can be performed at elevated temperature. Further, after the coating is applied, no further heat treating is required.

The present disclosure describes numerous embodiments of the present invention, and these embodiments are presented for illustrative purposes only. These embodiments are described in sufficient detail to enable those skilled in the art to practice the invention embodiments, and it will be appreciated that other embodiments may be employed and that structural, logical, software, electrical and other changes may be made without departing from the scope or spirit of the present invention. Accordingly, those skilled in the art will recognize that the present invention may be practiced with various modifications and alterations. Although particular features of the present invention can be described with reference to one or more particular embodiments or figures that form a part of the present disclosure, and in which are shown, by way of illustration, specific embodiments of the invention, it will be appreciated that such features are not limited to usage in the one or more particular embodiments or figures with reference to which they are described. The present disclosure is thus neither a literal description of all embodiments of the invention nor a listing of features of the invention that must be present in all embodiments.

The invention claimed is:

1. A method for producing ammunition, comprising:
providing a copper bullet;
depositing a nickel-phosphorous alloy on the copper bullet to produce a coated bullet;
inserting a propellant comprising a copper inhibiting additive in a casing, wherein the casing comprises a mouth; and
inserting at least a portion of the coated bullet in the mouth of the casing.

2. The method of claim 1, wherein the coated bullet comprises a nickel-phosphorous coating measuring up to and including 0.0005 inches in thickness.

3. The method of claim 1, wherein the nickel-phosphorous alloy comprises a phosphorous content of five to nine percent.

4. The method of claim 1, wherein depositing the nickel-phosphorous alloy on the copper bullet is performed without current.

5. The method of claim 1, wherein depositing the nickel-phosphorous alloy on the copper bullet comprises placing the copper bullet in a plating bath.

6. A firearm cartridge, comprising:
a casing comprising a rearward primer, a wall defining a cavity and a mouth;
a propellant comprising a copper inhibiting additive positioned in the cavity of the casing; and
a copper bullet secured within the mouth of the casing, wherein the copper bullet comprises a nickel-phosphorous coating.

7. The firearm cartridge of claim 6, wherein the nickel-phosphorous coating is produced via electroless nickel plating.

8. The firearm cartridge of claim 6, wherein the nickel-phosphorous coating measures up to and including 0.0005 inches in thickness.

9. The firearm cartridge of claim 6, wherein the nickel-phosphorous coating is produced by bathing the copper bullet in a nickel-phosphorous alloy.

10. The firearm cartridge of claim 9, wherein the nickel-phosphorous alloy comprises a phosphorous content of five to nine percent.

11. The firearm cartridge of claim 9, wherein bathing the copper bullet in the nickel-phosphorous alloy is performed without current.

* * * * *